US006283785B1

(12) United States Patent
Daoud

(10) Patent No.: US 6,283,785 B1
(45) **Date of Patent: *Sep. 4, 2001**

(54) CONNECTOR TOP CAP

(75) Inventor: Bassel H. Daoud, Parsippany, NJ (US)

(73) Assignee: Avaya Technology Corp., Basking Ridge, NJ (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/217,801

(22) Filed: Dec. 21, 1998

(51) Int. Cl.[7] ..... H01R 4/24
(52) U.S. Cl. ..... 439/409; 439/521; 439/417
(58) Field of Search ..... 439/148, 135, 439/521, 910, 912, 519, 405, 417, 482, 271, 272, 277, 278, 282, 594, 587

(56) References Cited

U.S. PATENT DOCUMENTS

| | | | | |
|---|---|---|---|---|
| 3,611,264 | | 10/1971 | Ellis | 439/403 |
| 3,989,334 | * | 11/1976 | Fortino | 439/148 |
| 4,396,245 | * | 8/1983 | Lane | 439/148 |
| 4,662,699 | | 5/1987 | Vachhani et al. | 439/395 |
| 4,946,393 | * | 8/1990 | Borgstrom et al. | 439/912 |
| 5,149,281 | * | 9/1992 | Hills et al. | 439/912 |
| 5,240,432 | * | 8/1993 | Daoud | 439/417 |
| 5,472,352 | * | 12/1995 | Nishide et al. | 439/587 |
| 5,496,192 | * | 3/1996 | Hower et al. | 439/409 |
| 5,971,795 | * | 10/1999 | Daoud et al. | 439/409 |
| 5,993,243 | * | 11/1999 | Daoud | 439/409 |
| 6,077,112 | * | 6/2000 | Daoud et al. | 439/521 |

* cited by examiner

*Primary Examiner*—Tulsidas Patel
(74) *Attorney, Agent, or Firm*—Stroock & Stroock & Lavan LLP

(57) ABSTRACT

A seal for sealing a connector having a test aperture includes a body and a latch formed with the body, the latch including a first deflection beam formed on one side of the body and a second deflection beam formed on an opposite side of the body. The latch also can include a first hook formed with the first deflection beam and a second hook formed with the second deflection beam. The first hook and the second hook are each pivotable between a first latched position and a second unlatched position when the first deflection beam and the second deflection beam are compressed.

12 Claims, 9 Drawing Sheets

CONNECTOR TOP CAP

FIELD OF THE INVENTION

This invention relates to the field of telephone wire connector blocks and distribution systems, and specifically for a cap or seal for sealing a test channel of a connector.

BACKGROUND OF INVENTION

In a telephone network, a network cable from the central office is connected to a building entrance protector (BEP) located at the customer site, where the individual telephone lines are broken out line-by-line. The network cable, which consist of a plurality of tip-ring wire pairs that each represent a telephone line, is typically connected to a connector block that forms a part of the BEP. Such connectors may be, for example, mini rocker tool-less insulation displacement (IDC)-type connectors, such as, for example, those sold by A. C. Egerton, Ltd. Other connectors used for telephony wiring applications are described in U.S. Pat. No. 4,662,699 to Vachhani et al., dated May 5, 1987, and in U.S. Pat. No. 3,611,264 to Ellis, dated Oct. 5, 1971.

The customer telephone equipment is coupled through such an IDC connector to, for example, a central office telephone line. The connector generally has a top section that includes two wire insertion holes and a bottom section that houses a pair of terminal strips. The wire insertion holes each accommodate one wire of a tip-ring wire pair. The top section pivots about a generally hinged fixed axis located on the side opposite the wire insertion holes and has a movable clasp for maintaining the top section in its closed position.

To open the top section, a user releases the clasp member and pivots the top section to its open position. When the top section is in its open position, the terminal strips do not intersect the wire insertion holes, but when the top section is in its closed position, the terminal strips intersect the wire insertion holes. Therefore, to establish an electrical and mechanical connection between the wires and the terminal strips, a user first opens the top section (i.e., pivots the top section to its open position), inserts the pair of wires, and then closes the top section. Upon closing the top section of the connector, the wires are brought into electrical and mechanical contact with the terminal strips. To remove the wires and/or break the electrical connection, the process is reversed.

To verify the integrity of a telephone line, the telephone line may be tested at the connector. The size of a connector makes it difficult for a craftsperson to manipulate the connector without the risk of compromising the connection between the wire and the terminal strip within the connector. For this reason, conventional connectors have been designed to afford test access by providing test channels that are open at all times. In this way, the chance of disrupting the electrical connection during testing is minimized. The connector itself, however, is left vulnerable to elements, such as dust or other particles, which can damage the integrity of the connector and the electrical connection. To minimize potential damage to the connector, it is desirable to provide a connector that has test channels that are closed at all times, except when access is required to test a particular connector.

SUMMARY OF THE INVENTION

The present invention is directed at overcoming the shortcomings of the prior art. A connector can be provided that includes a housing having a test channel, a terminal strip disposed within the housing and in communication with the test channel, and a membrane that seals the test channel. In this way, unlike conventional connectors, which have test channels that are open at all times, the connector of the present invention does not include conventional test channels. Instead, the test channels are closed to outside contaminants by a membrane.

In addition, an access tool can be provided that includes a first plier member having a first jaw and a first grip pivotably mounted to the first jaw, a second plier member having a second jaw and a second grip pivotably mounted to the second jaw, and an awl having a first rod pivotably mounted to the first grip, a second rod pivotably mounted to the first rod and to the second grip, and a punch slidably mounted to the first and second jaws for sliding relative to the first and second jaws at a third position. At a first position, the first and second jaws are out of engagement with a cap of a connector; at a second position the first and second jaws are engaged with the cap of the connector, and at a third position, as the first and second grips are squeezed toward one another, the punch moves in a direction away from the tips of the first and second grips to pierce a hole in the membrane covering the test channel access point, thereby permitting the craftsperson to test the connector by inserting a test lead through the now open and accessible test channel and into contact with the terminal strip.

In addition, the connector can be provided with a seal that seals the test channel after the connector has been tested. The seal can have a body and a latch movable between a first position wherein the seal is not secured to the connector, and a second position wherein the seal is secured to the connector. In another embodiment, the seal can be a plug that is frictionally fastened within the test channel to seal the channel. Because the connector is generally sealed, the use of sealing gel may be minimized or eliminated.

Other objects and features of the present invention will become apparent from the following detailed description, considered in conjunction with the accompanying drawing figures. It is to be understood, however, that the drawings, which are not to scale, are designed solely for the purpose of illustration and not as a definition of the limits of the invention, for which reference should be made to the appended claims.

BRIEF DESCRIPTION OF THE DRAWINGS

In the drawing figures, which are not to scale, and which are merely illustrative, and wherein like reference numerals depict like elements throughout the several views.

DETAILED DESCRIPTION OF THE PREFERRED EMBODIMENTS

Generally speaking, in accordance with the present invention, a connector testing system is provided that provides a more reliable testing configuration, and a connector that is better protected.

Figure 6A:
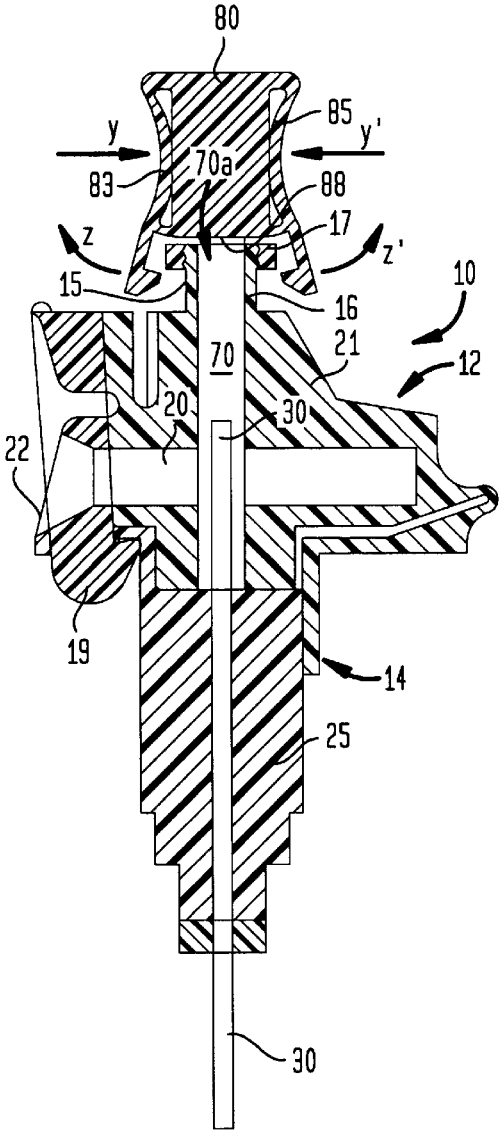
FIGS. 6A and 6B are side elevational views of a seal constructed in accordance with the present invention in a first and second position.
Figure 6B:
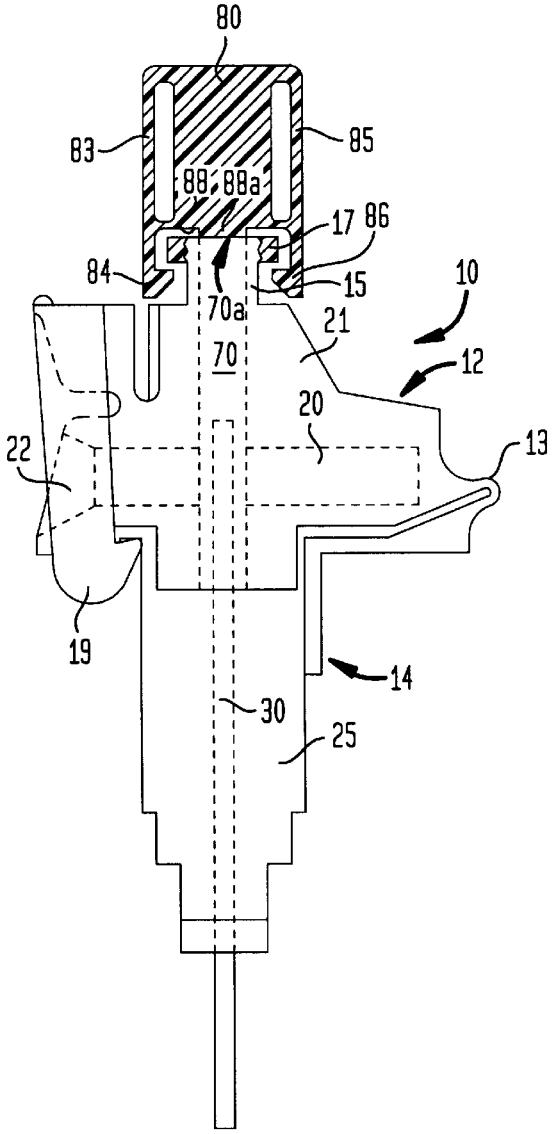
Figure 7:
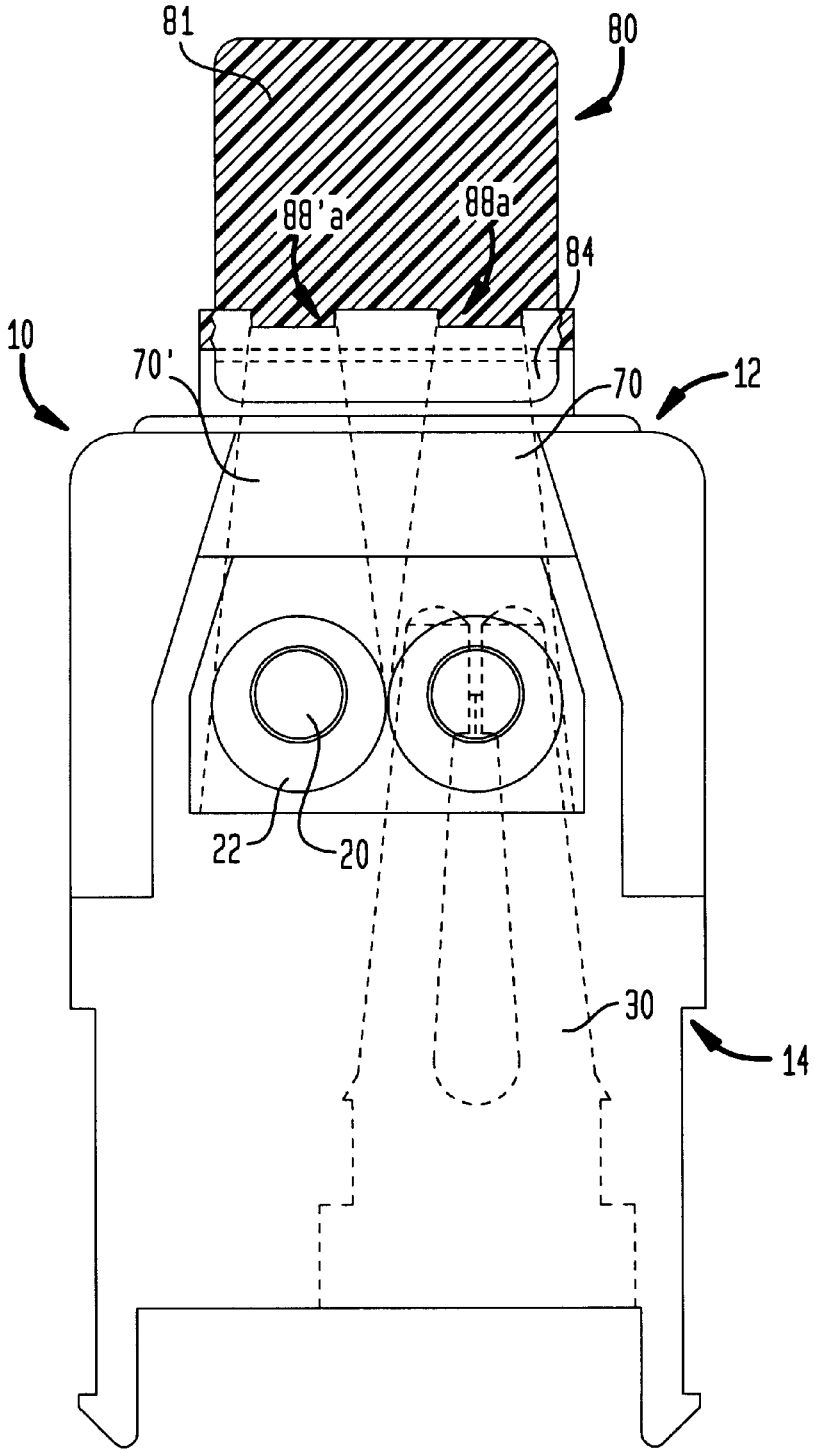
FIG. 7 is a front elevational view of the seal of FIG. 6B.

Referring initially to FIGS. 6B and 7, a connector 10 is shown with a connector seal 80, which is described more fully herein. Connector 10 includes a top section 12, a hinge 13, a bottom section pivotably mounted to top section 12 about hinge 13, and a clasp 19, which is selectively movable between an engaged position for engaging top section 12 to bottom section 14 (as shown in FIGS. 6B and 7) and a disengaged position (not shown). Connector 10 has two entrance apertures 22 that lead to wire insertion holes 20. Wire insertion holes 20 are constructed so as to accept electrical conductors in a manner known in the art (not shown). Connector 10 is preferably formed of a molded synthetic resinous material with good insulating properties and mechanical strength, e.g. a plastic. The specific materials utilized in constructing connector 10 are an application-specific matter of design choice within the knowledge of the person of skill familiar with wiring connectors and terminal blocks utilized in telephony.

Connector 10 also includes a pair of terminal strips 30, 30' (FIG. 9) and a housing 25 constructed to accept the pair of terminal strips 30 when the top section 12 is in the closed position as shown in FIGS. 6B and 7. Terminal strip 30 may be formed of any commonly known electrically conductive metal or electrical conductor known in the art and suitable for use in such terminals, such as, for example, platinum-washed phosphor bronze, or beryllium-copper alloy or any other material, metal or alloy combining good electrical conductivity with sufficient mechanical strength and resilience. Moreover, the means of affixing terminal strip 30 within connector housing 25 may be by snap fitting or by any one of the numerous methods of affixation known in the art, such as by way of non-limiting example, adhesives, friction fitting, integral molding, screws, and the like, depending on whether ready removal and re-insertion of the terminal is required, as a matter of application-specific design choice.

Referring to FIGS. 6A and 6B, an upper portion of top section 12 of connector 10 includes a plinth 21 and a cap 15 having a base 16 that extends from plinth 21. Cap 15 includes a flange 17, which extends outward from the top of base 16 and forming a lip thereon, thereby giving cap 15 a substantially t-shaped profile when seen from the side elevational view.

To facilitate testing of connections made through connector 10, test channels 70, 70' (FIG. 7) are formed within housing 25, top section 12 and bottom section 14 to permit test leads or probe tips (not shown) to contact terminal strips 30. Cap 15 includes a membrane 18 (FIG. 1) that closes one end of test channels 70, 70'. Membrane 18 may be formed of any molded synthetic resinous material, or it may be a plastic adhesive-backed material, such as for example tape, and should be of a thickness that prevents particles from entering test channel 70. Membrane 18 is preferably integrally formed with and of the same material as cap 15, but it may also be a separate member that is fastened to cap 15 by any known affixation means in the art, such as, by way of non-limiting example, adhesives, friction fitting, integral molding, screws, and the like, as a matter of application-specific design choice.

Referring now to FIGS. 1–5, a hand held, grippable test access tool 40 for creating a test aperture in a connector having a cap, is provided. As is shown particularly at FIG. 1, test access tool 40 includes a first plier member 41 that has a first jaw 43 and a first grip 42 pivotably mounted to first jaw 43 at a pivot 46. First jaw 43 includes a first latch 47 for engaging cap 15 of connector 10. A first spring 45 is mounted at a mounting point 44 formed on first grip 42 and a mounting point 48 formed on first jaw 43. First spring 45 is fastened to mounting points 44, 48 by fasteners 49*a* and 49*b*, which may be any fasteners known to those skilled in the art. First spring 45 biases first grip 41 to first jaw 43 at a first position and a second position, shown in FIGS. 1 and 2, respectively. At a third position, shown in FIG. 3, first grip 41 is pivotable relative to first jaw 43 at pivot 46. As used herein, the term spring is intended to mean any biasing device known in the art, such as, for example, elastic bands, tension rods, leaf springs, and the like.

Test access tool 40 also includes a second plier member 51 that has a second jaw 53 and a second grip 52 pivotably mounted to second jaw 53 at a pivot 56. Second plier member 51 is pivotably mounted to first plier member 41 and is pivotable relative to first plier member 41 at the first and second positions. A second spring 55 is mounted at a mounting point 54 formed on second grip 52 and a mounting point 58 formed on second jaw 53. Second jaw 53 includes a second latch 57 for acting with first latch 47 to engage cap 15 of connector 10. Second spring 55 is fastened to mounting points 54, 58 by fasteners 59*a* and 59*b*, which may be any fasteners known to those skilled in the art. Second spring 55 biases second grip 51 to second jaw 53 at the first and second positions, shown in FIGS. 1 and 2, respectively. At a third position, shown in FIG. 3, second grip 51 is pivotable relative to second jaw 53 at pivot 56.

Figure 2:
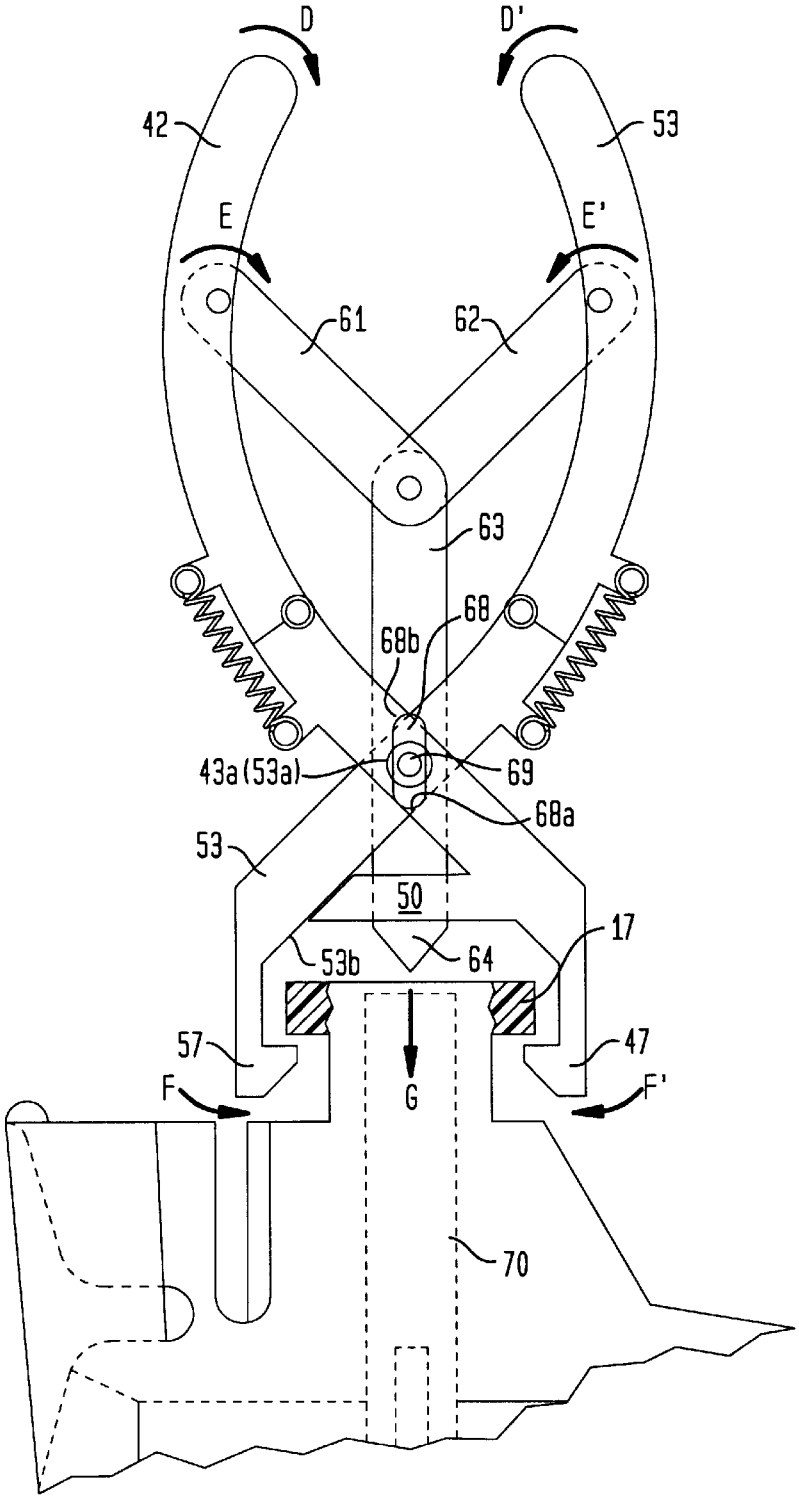
FIG. 2 is a side elevational view of the test access tool and connector of FIG. 1 in a second position.

Test access tool 40 further includes a piercing device, such as an awl 60 having a first rod 61 pivotably mounted to first grip 42 at a pivot 65 and a second rod 62 pivotably mounted to first rod 61 at a pivot 67 and second grip 52 at a pivot 66. Awl 60 includes a punch 63 having a slot 68 slidably mounted to first jaw 43 and second jaw 53 at a pin 69 for sliding relative to first jaw 43 and second jaw 53. Punch 63 includes a lancet 64 formed at the free end of punch 63 for piercing an access hole in connector 10. Slot 68 includes a lower edge 68*a* and an upper edge 68*b* as is shown in FIG. 2. First jaw 43 has a throughhole 43*a* and second jaw 53 has a throughhole 53*a* for communicating with slot 68 of punch 63. Pin 69 extends through first jaw throughhole 43*a*, slot 68 and second jaw throughhole 53*a* and forms a pivot joint, such that first jaw 43 is pivotable with respect to second jaw 53 and punch 63 is slidable with respect to first and second jaws 43, 53 around pin 69.

Pivots 46, 56, 65, 66, 67 and 69 may consist of a screw and nut fastening arrangement, or a bolt and retention member that are snap fit together, or a bolt and cotter pin, or a flanged pin or axle, or any other fastening configuration or hinge that permits the members to pivot with respect to one another.

Test access tool 40 preferably includes a strut 50 connected to an inside surface 43*b* of first jaw 43. When first plier member 41 is in the second position, depicted in FIG. 2, strut 50 prevents first jaw 43 from moving with respect to second jaw 53 in a gripping direction shown as arrows F and F' by contacting an inside surface 53*b* of second jaw 53. In this manner, strut 50 prevents cap 15 of connector 10 from being crushed by preventing the overpivoting of first jaw 43 and second jaw 53 when the craftsperson secures test access tool 40 to connector 10.

Figure 1:
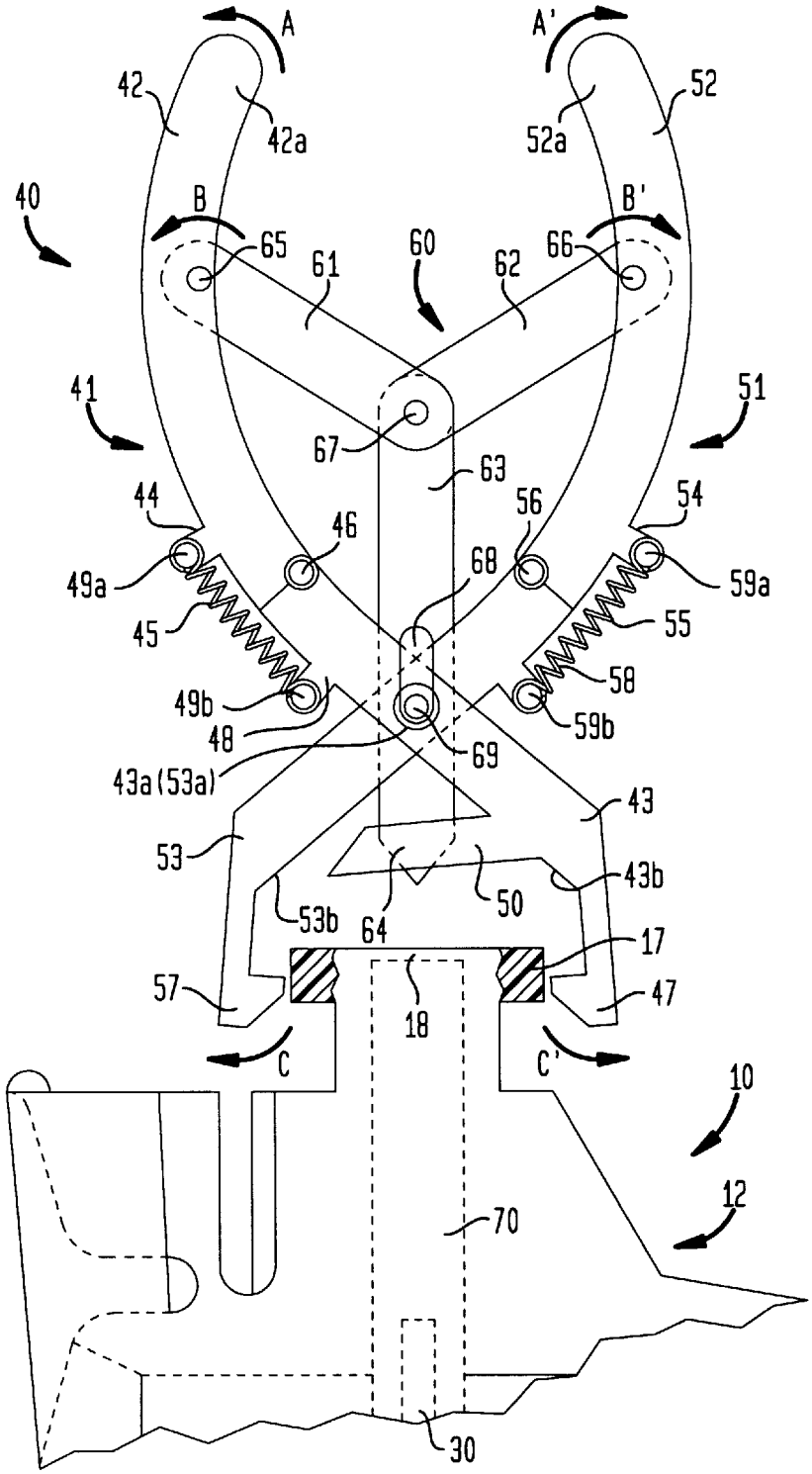
FIG. 1 is a side elevational view of the test access tool and connector constructed in accordance with the present invention in a first position.

Referring to FIG. 1, to use access tool 40, the craftsperson pivots first and second grips 42, 52 in directions respectively shown as arrows A and A', thereby pivoting first rod 61 in the direction shown as arrow B about pivot 65 and second rod 62 in the direction shown as arrow B' about pivot 66, and first jaw 43 and second jaw 53 in directions respectively shown as arrows C and C' about pin 69. In the fully open position depicted in FIG. 1, pin 69 travels within slot 68 to lower edge 68*a* thereby fully releasing punch 63 and preventing any further pivoting of first and second grips 42, 52 in the direction shown as arrows A, A'. In this first position, the craftsperson may position test access tool 40 over flange 17 of cap 15 as the distance between first latch 47 and second latch 57 is greater than the diameter of flange 17. This first position is the preferred position for the tool at rest, and the tool is preferably biased to return to this position when not in use.

Referring to FIG. 2, to secure test access tool 40 to connector 10, the craftsperson pivots first and second grips 42 and 52 in the direction indicated by arrows D and D', thereby pivoting first rod 61 in the direction shown as arrow E about pivot 65 and second rod 62 in the direction shown as arrow E' about pivot 66, and first jaw 43 and second jaw 53 in directions respectively shown as arrows F and F' about pin 69. As first rod 61 and second rod 62 pivot about pivots 66 and 67, punch 63 slides within slot 68 in a direction indicated by arrow G to a position intermediate upper edge 68*b* and lower edge 68*a* of slot 68. At this location, strut 50 contacts inner surface 53*b* of second jaw 53 to prevent further motion of first jaw 43 with respect to second jaw 53, first and second latches 47, 57 secure test access tool 40 to cap 15 of connector 10, and lancet 64 is positioned above membrane 18 of cap 15. In this position, cap 15 is retained by tool 40 and ready for the aperture to be formed.

Figure 3:
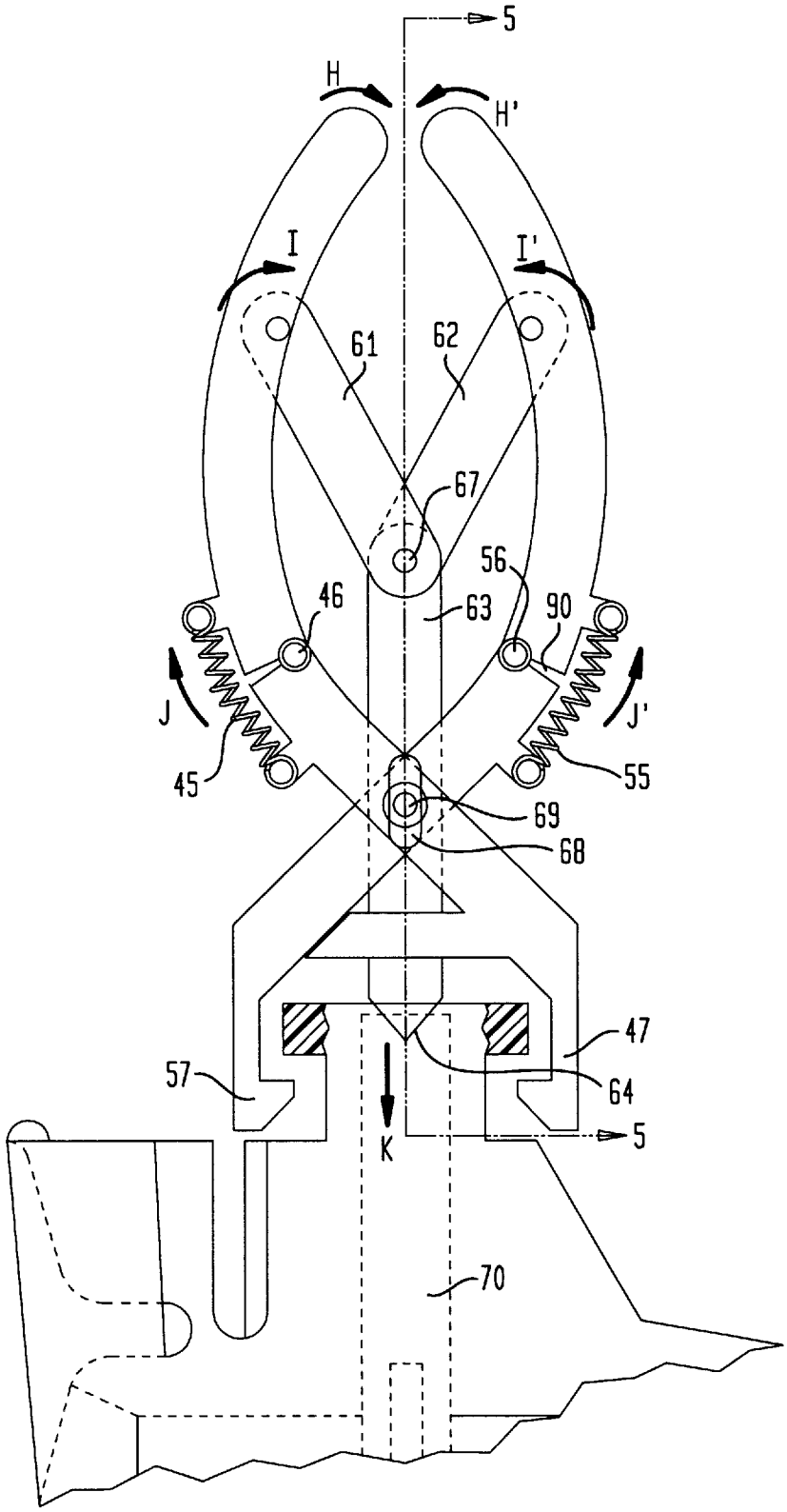
FIG. 3 is a side elevational view of the test access tool and connector of FIG. 1 in a third position.
Figure 4:
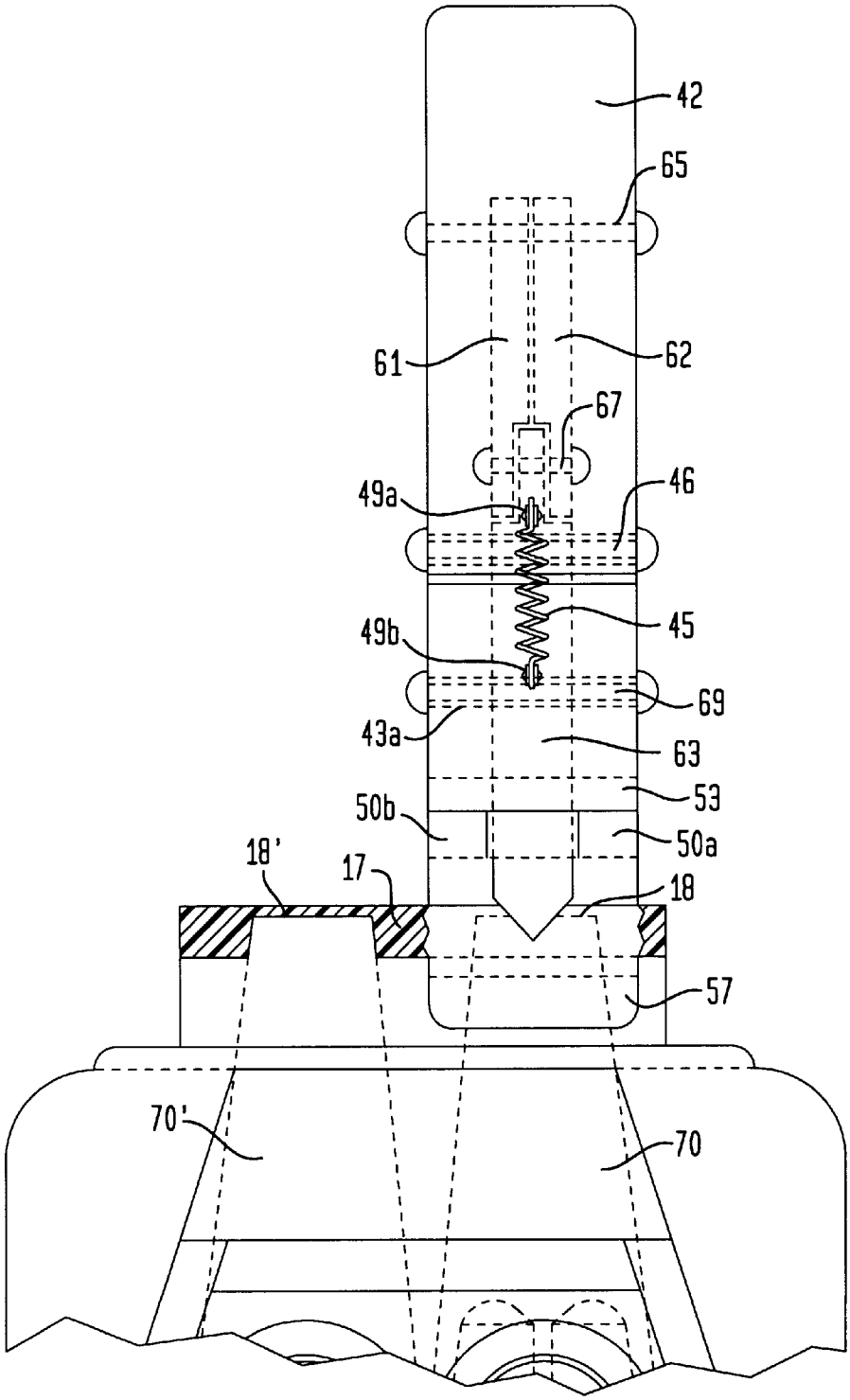
FIG. 4 is a front elevational view of the test access tool and connector of FIG. 3.
Figure 5:
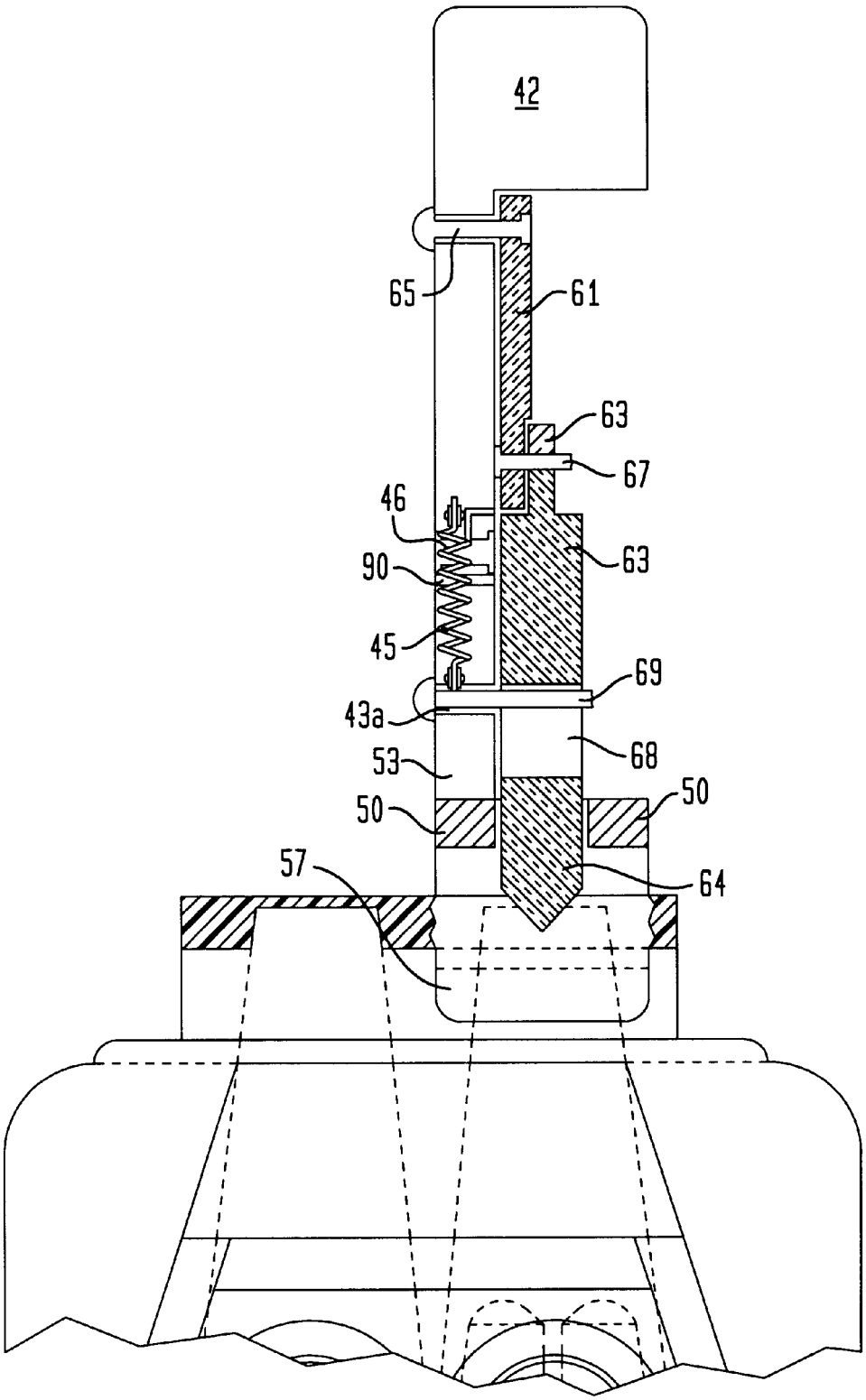
FIG. 5 is a front elevational cross-sectional view of the test access tool and connector taken along line 5—5 of FIG. 3.

Referring to FIGS. 3 and 4, to pierce a test access hole in connector 10, the craftsperson further pivots first and second grips 42 and 52 in the direction indicated by arrows H and H'. Because strut 50 contacts inner surface 53*b* of second jaw 53, first jaw 43 and second jaw 53 are prevented from moving in the gripping direction. As such, the force imparted by the craftsperson on first and second grips 42, 52, causes the biasing force of first and second springs 45, 55 to be overcome and first grip 42 rotates relative to first jaw 43 in the direction indicated by arrow J and second grip 52 rotates relative to second jaw 53 in the direction indicated by arrow J', thereby pivoting first rod 61 in the direction shown as arrow I about pivot 65 and second rod 62 in the direction shown as arrow I' about pivot 66. As first rod 61 and second rod 62 pivot about pivots 66 and 67, punch 63 slides within slot 68 in a direction indicated by arrow K to a third position where lancet 64 pierces an access hole 70*a* in membrane 18 (FIG. 6A). Lower edge 68*a* is positioned and slot 68 is sized to permit lancet 64 to travel through a predetermined distance to pierce membrane 18.

Once access hole 70*a* has been created by test access tool 40, the craftsperson may disengage test access tool 40 from connector 10 by once again pivoting first and second grips 42, 52 in directions respectively shown by arrows A and A', thereby pivoting first rod 61 in the direction shown as arrow B about pivot 65 and second rod 62 in the direction shown as arrow B' about pivot 66, and first jaw 43 and second jaw 53 in directions respectively shown as arrows C and C' about pin 69. The craftsperson pivots first and second grips 42, 52 until punch 63 is fully disengaged from cap 15 and first and second jaws 47, 57 disengage from flange 17 of cap 15.

Once test access tool 40 is disengaged, the craftsperson may create a second access hole 70'*a* in membrane 18' (or in a second location of membrane 18) to permit testing in test channel 70' by positioning test access tool 40 over membrane 18' of cap 15, which seals test channel 70' from outside contaminants, and gripping first and second grips 42, 52 until lancet 64 pierces membrane 18' in the same fashion as described above. Alternatively, the tool may be designed such that punch 63 comprises two lancets 64 for forming access apertures in membranes 18 and 18' over both terminal strips 30, 30' (see FIG. 9) at approximately the same time.

Once test access tool 40 is disengaged a second time, the craftsperson may test the wire connection at connector 10 by inserting the test leads of a bridge clip or test probe (not shown) into test channels 70 and 70' until the test leads contact terminal strips 30, 30'.

After testing the connection, the craftsperson preferably closes test apertures 70*a* and 70'*a*. Referring to FIGS. 6A, 6B and 7, seal 80 is depicted. Seal 80 is preferably spring-loaded; i.e., seal 80 is normally biased to its closed position. Seal 80 includes a body 81, having a mating surface 88, and a latch 82, having a first beam 83 formed with a first hook 84 and a second beam 85 formed with a second hook 86. Preferably, beams 83, 85 and hooks 84, 86 are integrally formed with body 81, however, hooks 84, 86 may be connected to beams 83, 85 in any fashion known to those skilled in the art. First hook 84 and second hook 86 are constructed to matingly engage with flange 17 of cap 15. A portion 88*a* of a mating surface 88 may be formed to engage and partially enter access hole 70*a* formed by punch tip 64 of test access tool 40, as a matter of design choice.

As shown in FIG. 6A, to engage seal 80 to connector 10, the craftsperson compresses beams 83, 85 in the directions shown as arrows Y, Y' to rotate hooks 84, 86 outward in the directions shown by arrows Z, Z'. Once hooks 84, 86 rotate a distance sufficient to clear flange 19, the craftsperson may cease compressing beams 83, 85, thereby permitting hooks 84, 86 to rotate to the closed position and engage flange 19 of cap 15 of connector 10. Thus, latch 82 is in its open position as shown in FIG. 6A, when beams 83, 85 are deflected inwardly by forces Y, Y'. Conversely, as shown in FIG. 6B, latch 82 is in its closed position when first hook 84 and second hook 86 engage flange 17 of cap 15. In the closed position, seal 80 seals test channels 70, 70' to prevent particles from entering the channels.

Figure 8:
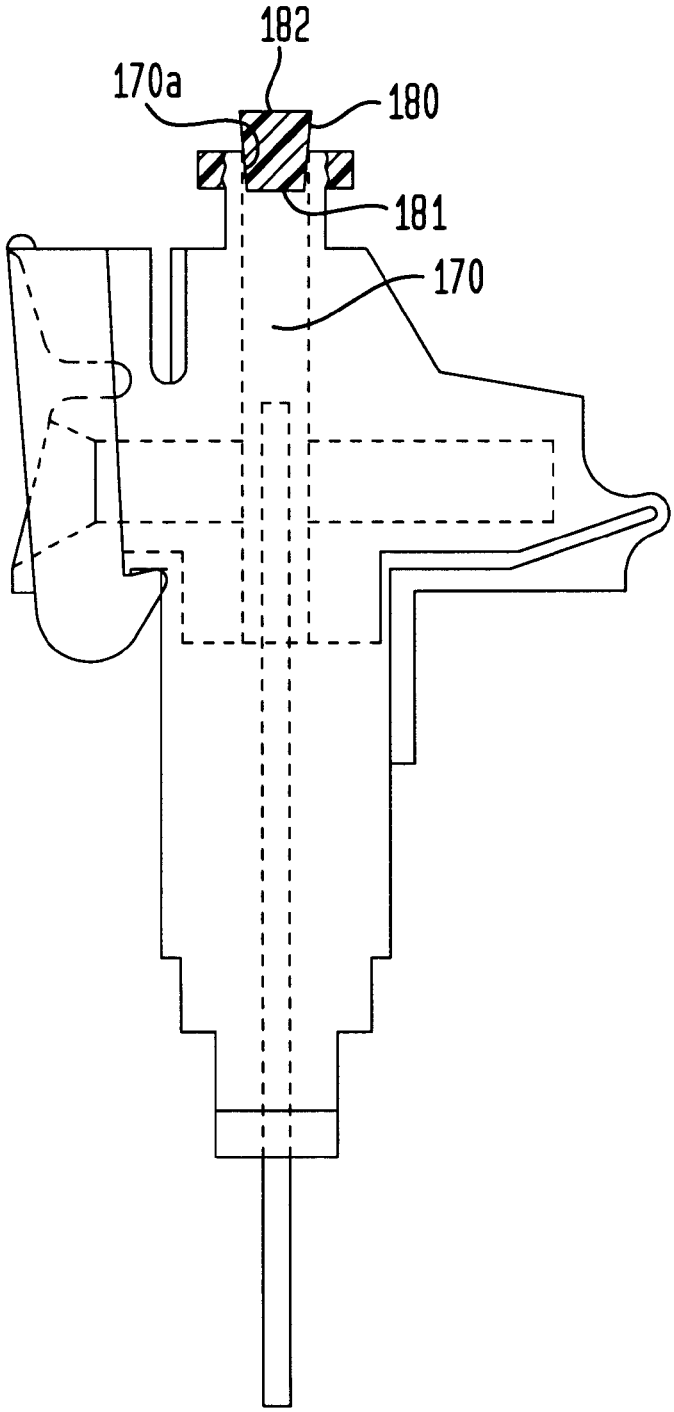
FIG. 8 is a side elevational view of a second embodiment of a seal constructed in accordance with the present invention.
Figure 9:
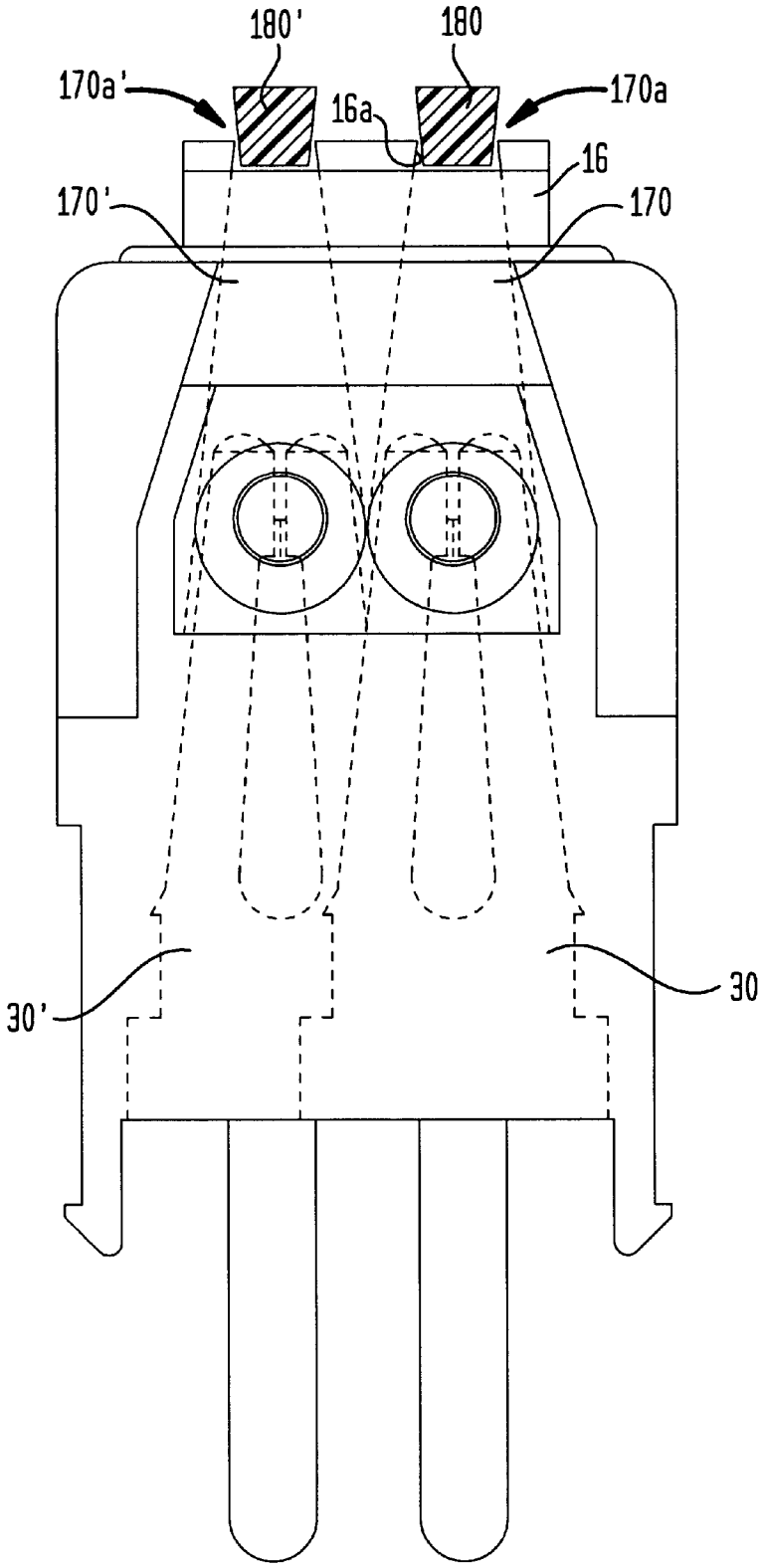
FIG. 9 is a front elevational view of the cap of FIG. 8.

Referring to FIGS. 8 and 9, a second embodiment of a seal 180, 180' is depicted, wherein elements common to the first seal embodiment depicted in FIGS. 6A, 6B and 7 are designated with similar numerals. Seal 180 includes an inner diameter 181 and an outer diameter 182, which is shorter in length compared to inner diameter 181. Seal 180 is preferably formed in the shape of a trapezoid in cross section, but may be formed in any cross-sectional shape having an inner diameter 181 and a longer, outer diameter 182. Seal 180, 180' is preferably a malleable plug of, for example, a rubber or rubber-like material, so as to frictionally fit into access holes 170*a*, 170'*a* and against an inner surface 16*a* of cylinder 16 to seal test channels 170, 170', although the specific material and slope of the seal is a matter of design choice . In this manner, after testing connectors 10, the craftsperson may seal the access hole created in the connector to permit testing by employing a seal sized to plug the access hole.

Thus, while there have been shown and described and pointed out fundamental novel features of the invention as applied to preferred embodiments thereof, it will be understood that various omissions and substitutions and changes in the form and details of the disclosed invention may be made by those skilled in the art without departing from the spirit of the invention. It is the intention, therefore, to be limited only as indicated by the scope of the claims appended hereto.

What is claimed is:

1. A connector and seal assembly comprising:

a connector having a top section and a bottom section, said top section being angularly hingedly movable between an open position and a closed position, said top section having therein at least one wire insertion hole for guidedly receiving a wire, said wire insertion hole having an entrance aperture for entry of said wire, said open position facilitating entry of said wire in said wire insertion hole;

said bottom section comprising a housing, said housing including a terminal strip for mechanical and electrical mating with said wire when said top section is in said closed position;

the top section further having a test aperture and test channel formed therein, and an engagement surface proximate the test aperture;

said test aperture and said test channel providing a fluid communication path to said terminal strip that is distinct from said entrance aperture and said wire insertion hole; and a seal comprising a body dimensioned for shape mating engagement with the engagement surface and comprising a latch, the latch comprising a first deflection beam formed on one side of said body and a second deflection beam formed on an opposite side of said body, said first and said second deflection beams each being so dimensioned as to releasably facilitate said shape mating engagement with said engagement surface.

2. The connector and seal assembly of claim 1, said seal further comprising:

a first hook formed with the first deflection beam; and a second hook formed with the second deflection beam, the first hook and the second hook each pivotable between a first latched position and a second unlatched position when the first deflection beam and the second deflection beam are compressed.

3. The connector and seal assembly of claim 2, wherein the first hook and the second hook are shaped and sized to matingly engage a flange of the connector in the first latched position.

4. The connector and seal assembly of claim 1, wherein the latch is moveable between a first latched position and a second unlatched position.

5. The connector and seal assembly of claim 1, further comprising a projection member formed on the body, the projection member being adapted to be partially disposed within the test aperture when the seal is brought into shape mating engagement with the connector.

6. The connector and seal assembly of claim 2, further comprising a projection member adapted to matingly engage the test aperture when the first and second hooks are in the first latched position.

7. A connector and seal assembly comprising:

a connector having a top section and a bottom section, said top section being angularly hingedly movable between an open position and a closed position, said top section having therein at least one wire insertion hole for guidedly receiving a wire, said wire insertion hole having an entrance aperture for entry of said wire, said open position facilitating entry of said wire in said wire insertion hole;

said bottom section comprising a housing, said housing including a terminal strip for mechanical and electrical mating with said wire when said top section is in said closed position;

the top section further having a test aperture and test channel formed therein, and an engagement surface proximate the test aperture;

said test aperture and said test channel providing a fluid communication path to said terminal strip that is distinct from said entrance aperture and said wire insertion hole; and a seal comprising a body dimensioned for shape mating engagement with the engagement surface; said seal further comprising a latch dimensioned so as to facilitate shape mating engagement with the engagement surface, connected to said body, the latch including a first hook pivotably connected to the first side of said body and a second hook pivotably connected to the second side of said body.

8. A connector, comprising:

a top section and a bottom section, said top section being angularly hingedly movable between an open position and a closed position, said top section having therein at least one wire insertion hole for guidedly receiving a wire, said wire insertion hole having an entrance aperture for entry of said wire, said open position facilitating entry of said wire in said wire insertion hole;

said bottom section comprising a housing, said housing including a terminal strip for mechanical and electrical mating with said wire when said top section is in said closed position;

the top section further having a test aperture and test channel formed therein, and an engagement surface proximate the test aperture;

said test aperture and said test channel providing a fluid communication path to said terminal strip that is distinct from said entrance aperture and said wire insertion hole; and means for sealing the test aperture.

9. A connector and seal assembly comprising:

a connector having a top section and a bottom section, said top section being angularly hingedly movable between an open position and a closed position, said top section having therein at least one wire insertion hole for guidedly receiving a wire, said wire insertion hole having an entrance aperture for entry of said wire, said open position facilitating entry of said wire in said wire insertion hole;

said bottom section comprising a housing, said housing including a terminal strip for mechanical and electrical mating with said wire when said top section is in said closed position;

the top section further having a test aperture and test channel formed therein, and an engagement surface proximate the test aperture;

said test aperture and said test channel providing a fluid communication path to said terminal strip that is distinct from said entrance aperture and said wire insertion hole; and a seal comprising a body dimensioned for shape mating engagement with the engagement surface.

10. The connector and seal assembly of claim 9, said seal further comprising a projection member formed on the body, the projection member being adapted to be partially disposed within the test aperture when the seal is brought into shape mating engagement with the connector.

11. A method for forming a connector and seal assembly, said method comprising:

providing a connector having a top section and a bottom section, said top section being angularly hingedly movable between an open position and a closed position, said top section having therein at least one wire insertion hole for guidedly receiving a wire, said wire insertion hole having an entrance aperture for entry of said wire, said open position facilitating entry of said wire in said wire insertion hole;

said bottom section comprising a housing, said housing including a terminal strip for mechanical and electrical mating with said wire when said top section is in said closed position;

the top section further having a test aperture and test channel formed therein, and an engagement surface proximate the test aperture;

said test aperture and said test channel providing a fluid communication path to said terminal strip that is distinct from said entrance aperture and said wire insertion hole;

disposing on a body a latch, said body being dimensioned for shape mating engagement with the engagement surface;

disposing on said latch a first deflection beam formed on one side of said body, said first deflection beam being dimensioned as to releasably facilitate said shape mating engagement with said engagement surface; and disposing on said latch a second deflection beam formed on an opposite side of said body, said second deflection beam being dimensioned as to releasably facilitate said shape mating engagement with said engagement surface.

12. The method of claim 11 further comprising:

providing a first hook being formed on said first deflection beam; and providing a second hook being formed with the second deflection beam, the first hook and the second hook each pivotable between a first latched position and a second unlatched position when the first deflection beam and the second deflection beam are compressed.

* * * * *